US009458737B2

(12) United States Patent
Roth et al.

(10) Patent No.: US 9,458,737 B2
(45) Date of Patent: Oct. 4, 2016

(54) ADJUSTABLE BRACING APPARATUS AND ASSEMBLY METHOD FOR GAS TURBINE EXHAUST DIFFUSER

(71) Applicants: Douglas R. Roth, Oviedo, FL (US); Mrinal Munshi, Orlando, FL (US)

(72) Inventors: Douglas R. Roth, Oviedo, FL (US); Mrinal Munshi, Orlando, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 519 days.

(21) Appl. No.: 14/045,836

(22) Filed: Oct. 4, 2013

(65) Prior Publication Data

US 2015/0098811 A1 Apr. 9, 2015

(51) Int. Cl.

| | |
|---|---|
| ***F03B 1/04*** | (2006.01) |
| ***F01D 25/28*** | (2006.01) |
| ***F01D 25/16*** | (2006.01) |
| ***F01D 25/24*** | (2006.01) |

(52) U.S. Cl.

CPC ..... *F01D 25/28* (2013.01); *F01D 25/162* (2013.01); *F01D 25/243* (2013.01); *F05D 2230/68* (2013.01); *Y10T 29/4932* (2015.01)

(58) Field of Classification Search

CPC ..... F01D 25/30; F01D 25/243; F01D 25/26; F01D 25/28; F01D 25/162; F05D 2230/64; F05D 2230/644; F05D 2260/30; F05D 2230/68

USPC ..... 415/207, 213.1, 214.1

See application file for complete search history.

(56) References Cited

U.S. PATENT DOCUMENTS

| | | | | |
|---|---|---|---|---|
| 1,420,460 | A * | 6/1922 | Sullivan | F16G 11/10 24/68 A |
| 2,968,467 | A | 1/1961 | McGregor | |
| 3,004,388 | A | 10/1961 | Foulon | |
| 4,274,805 | A | 6/1981 | Holmes | |
| 4,492,517 | A | 1/1985 | Klompas | |
| 4,571,936 | A | 2/1986 | Nash et al. | |
| 5,088,279 | A | 2/1992 | MacGee | |
| 5,513,547 | A | 5/1996 | Lovelace | |
| 6,141,862 | A | 11/2000 | Matsui et al. | |
| 6,839,979 | B1 | 1/2005 | Godbole et al. | |
| 7,165,934 | B2 * | 1/2007 | Reigl | F01D 25/26 415/108 |
| 7,584,621 | B2 | 9/2009 | Spitzer et al. | |
| 8,028,530 | B2 | 10/2011 | Commaret et al. | |
| 8,083,471 | B2 * | 12/2011 | Black | F01D 25/28 415/134 |
| 8,099,962 | B2 | 1/2012 | Durocher et al. | |
| 8,142,150 | B2 | 3/2012 | Frick et al. | |
| 2007/0031247 | A1 * | 2/2007 | Spitzer | F01D 25/162 415/182.1 |
| 2010/0287950 | A1 | 11/2010 | Heyerman et al. | |
| 2014/0001335 | A1 * | 1/2014 | Hurst | F01D 25/28 248/674 |

* cited by examiner

*Primary Examiner* — Eric Keasel
*Assistant Examiner* — Jason Mikus

(57) ABSTRACT

Length adjustable braces (56, 56A-D) attached between a gas turbine exhaust diffuser (40) and an exhaust casing (34) along a horizontal joint (50) between upper and lower halves (40A, 40B) of the outer diffuser shell. Brace lengths are adjusted to align bolt holes (52A, 52B) in respective bolt bosses (43A, 43B) on the upper and lower halves of the shell. The braces may be turnbuckles (56, 67) welded to or releasably attached at one end to the shell and at the other end to the casing. Exemplary fittings on the diffuser shell and casing for the brace ends may be clevis fittings (62) or eye fittings (72). The fittings may be configured to support both tension (58) and compression (59) of each brace. Two opposed fittings (70A, 70B) across the joint may be configured for insertion of a respective clevis bolt (63A, 63C) in both fittings from the same side.

15 Claims, 5 Drawing Sheets

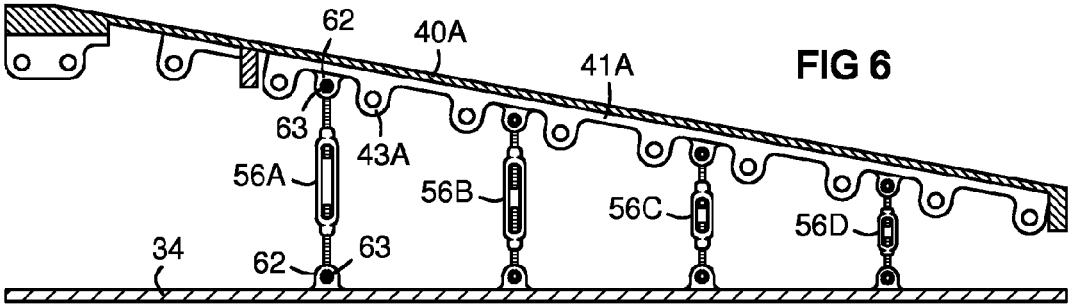
FIG 6
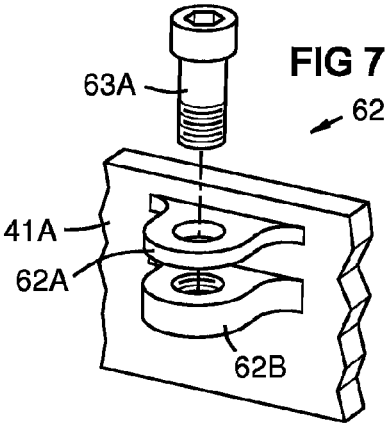
FIG 7
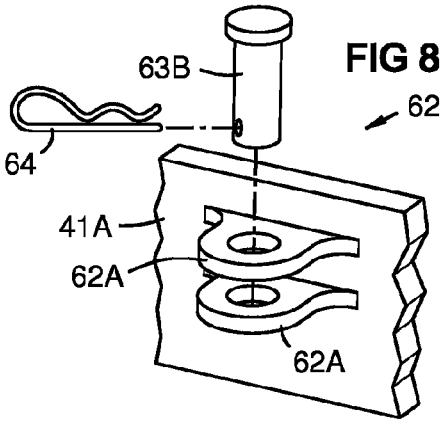
FIG 8
FIG 9
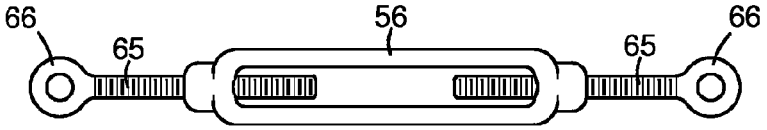
FIG 10
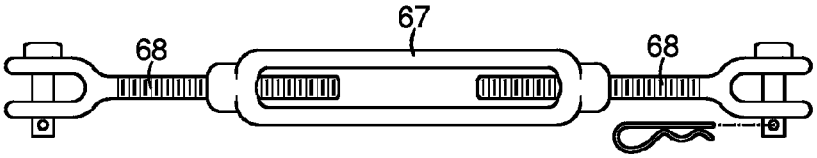

ADJUSTABLE BRACING APPARATUS AND ASSEMBLY METHOD FOR GAS TURBINE EXHAUST DIFFUSER

FIELD OF THE INVENTION

The invention relates to apparatus and assembly methods for a gas turbine exhaust section, and particularly to apparatus and methods for alignment of upper and lower halves of an exhaust diffuser outer shroud during transportation or during on site assembly and re-assembly.

BACKGROUND OF THE INVENTION

A gas turbine (GT) exhaust diffuser is a divergent annular flow path between inner and outer annular diffuser shells through which the exhaust gas passes. The cross-sectional area of the duct progressively increases in the flow direction to reduce the speed of the exhaust flow and increase its pressure. The exhaust diffuser is commonly fabricated in an upper and lower halves joined along horizontal joints between the inner and outer shells. The diffuser halves require complex fabrication, including complex machining profiles along the horizontal joints. There is potential for misalignment between the upper and lower halves, especially radial misalignment, which can make alignment of bolt holes for joining difficult.

The diffuser may operate at temperatures of 500-700° C. or more, and experiences thermal and mechanical stresses due to operational gradients and GT start/shutdown cycles. This results in material distortions that make it difficult to realign the halves of the diffuser after manufacturing, transport, and disassembly for servicing purposes.

BRIEF DESCRIPTION OF THE DRAWINGS

The invention is explained in the following description in view of the drawings that show:

FIG. 6 is a top sectional view of one side of the upper half of an exhaust diffuser outer shell with a series of turnbuckles spanning between an upper bolt flange and the exhaust section casing.

FIG. 7 is a perspective view of a threaded clevis fitting and clevis bolt.

FIG. 8 is a perspective view of a non-threaded clevis fitting and clevis pin.

FIG. 9 is a top view of a turnbuckle with eye bolts.

FIG. 10 is a top view of a turnbuckle with clevis-ends.

DETAILED DESCRIPTION OF THE INVENTION

Figure 1:
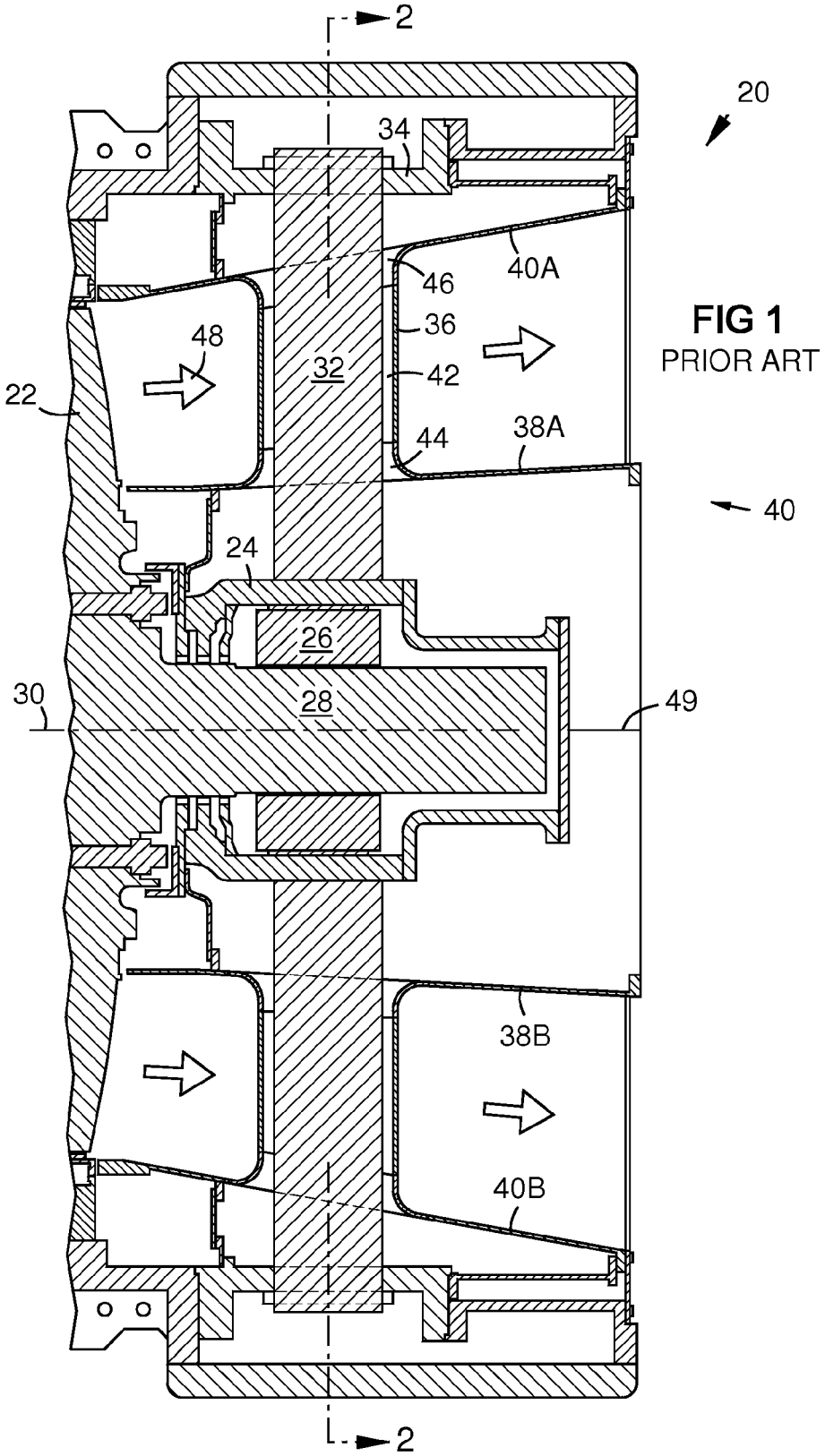
FIG 1 PRIOR ART
FIG. 1 is an axial sectional view of an exhaust section of a prior art gas turbine taken along line 1-1 of FIG. 2.

FIG. 1 illustrates an exhaust section 20 behind a last row of rotating blades 22 of a gas turbine engine. A bearing hub

Figure 2:
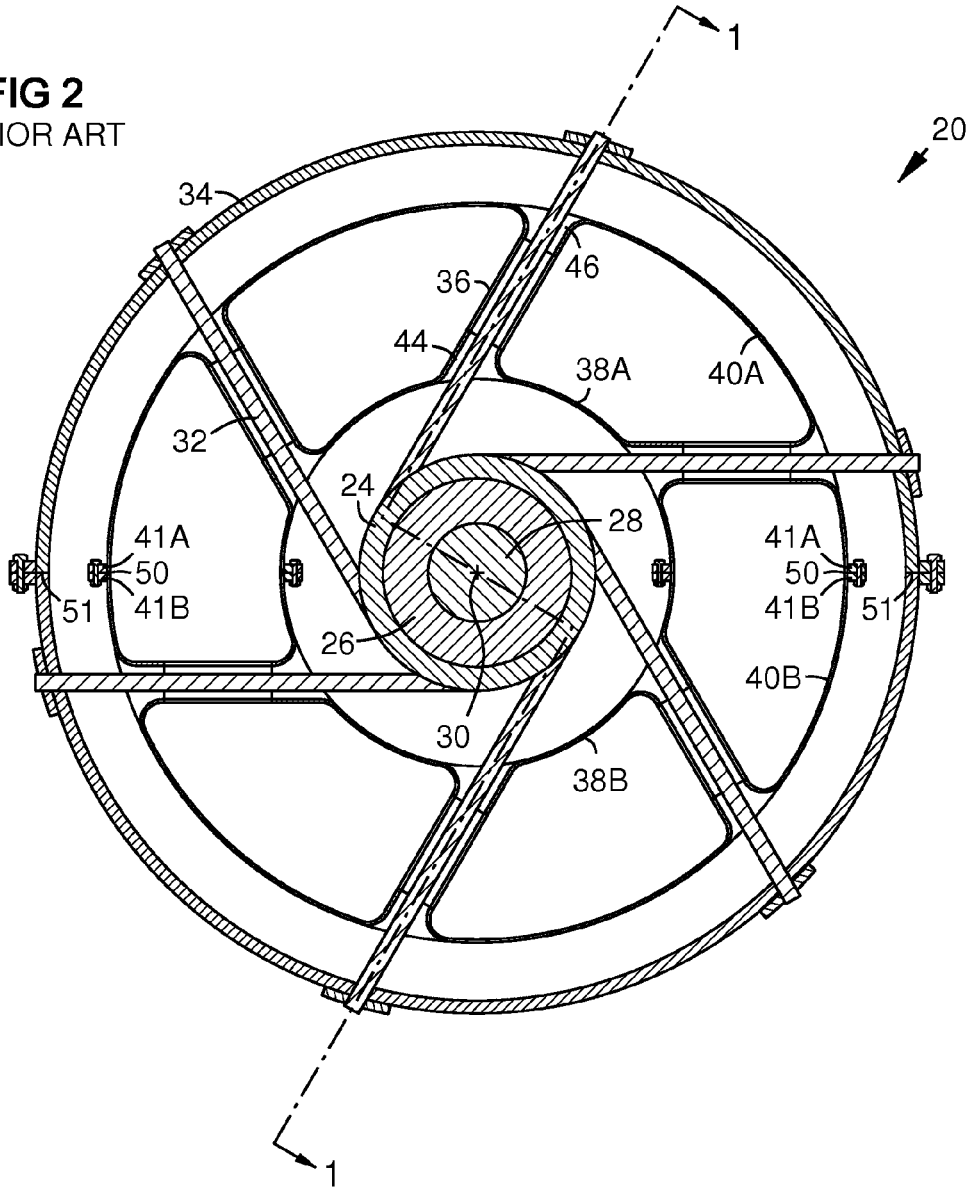
FIG 2 PRIOR ART
FIG. 2 is a transverse sectional view of the exhaust section of FIG. 1 taken along line 2-2.

24 may extend into the exhaust section and enclose an aft bearing 26 that supports the turbine shaft 28 for rotation about an axis 30. A diffuser 40 defines a divergent annular flow path for the exhaust gas 48. The diffuser may be fabricated as upper 38A and lower 38B inner shells and upper 40A and lower 40B outer shells. A horizontal joint 49 exists between the upper and lower inner shells 38A-B. A horizontal joint 50 (later shown) exists between the upper and lower outer shells 40A-B. Struts 32 may span between the hub and a casing 34 in a circular array. For conceptual clarity, in FIG. 1 the struts may be oriented radially, or they may be oriented tangentially to the hub as shown in FIG. 2. Each strut may be surrounded by a heat shield 36 connected between the inner 38A-B and outer 40A-B diffuser shells. Each shield is a tube that surrounds the strut and may provide space 42 for coolant flow along the strut. An inner collar 44 and an outer collar 46 on each shield 36 attach the shield to the respective diffuser shell 38A-B, 40A-B. Stress concentrations in these collars may contribute to distortions in the shells.

FIG. 2 is a transverse sectional view of the GT exhaust section 20 of FIG. 1. A hub 24 encloses an aft bearing 26 that supports the turbine shaft 28. A circular array of struts 32 connects the hub to the casing 34 for mutual support and positioning. The casing 34 is formed in halves and is bolted together at joint 51. The struts may be oriented radially or tangentially to the hub as shown to accommodate differential thermal expansion between the hub, struts, and case. Each strut is surrounded by a heat shield 36 connected between the inner 38A-B and outer 40A-B diffuser shells. An inner collar 44 and an outer 46 collar attach each heat shield to the respective diffuser shell 38A-B, 40A-B. The inner diffuser shell is formed in upper 38A and lower 38B halves. The outer diffuser shell is formed in upper 40A and lower 40B halves, which are joined along a horizontal joint 50 by respective bolt flanges 41A, 41B.

Figure 3:
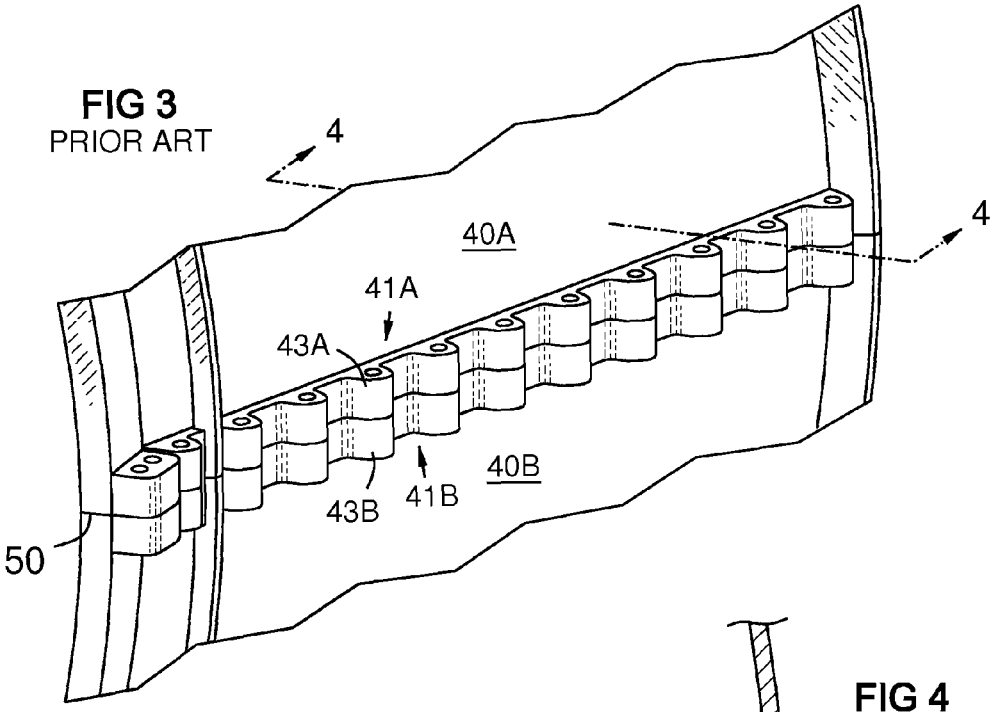
FIG 3 PRIOR ART
FIG. 3 is a perspective view of a prior art bolt flange joint between upper and lower halves of the outer diffuser shell.

FIG. 3 is a perspective view of a joint 50 between the upper 40A and lower 40B halves of the outer diffuser shell. Upper 41A and lower 41B bolt flanges may each have a respective series of upper and lower bolt bosses 43A, 43B that must be aligned so that bolts can be inserted through them.

Figure 4:
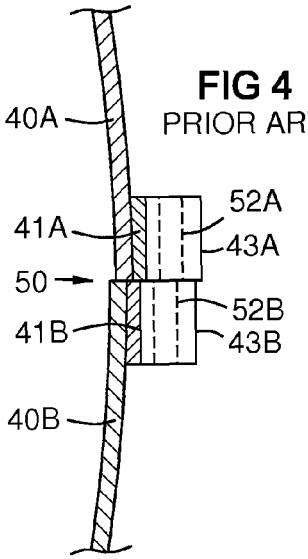
FIG 4 PRIOR ART
FIG. 4 is a sectional view of the bolt flange joint of FIG. 3 taken along line 4-4 of FIG. 3.

FIG. 4 is a front sectional view of the joint 50 between the upper 40A and lower 40B halves of the outer diffuser shell. The upper 43A and lower 43B bolt bosses must be aligned so that bolts can be inserted through respective aligned bolt holes 52A, 52B. Therefore, radial misalignment as shown must be corrected before this joint can be assembled. "Radial" herein is with respect the turbine axis 30 (FIGS. 1, 2)

Figure 5:
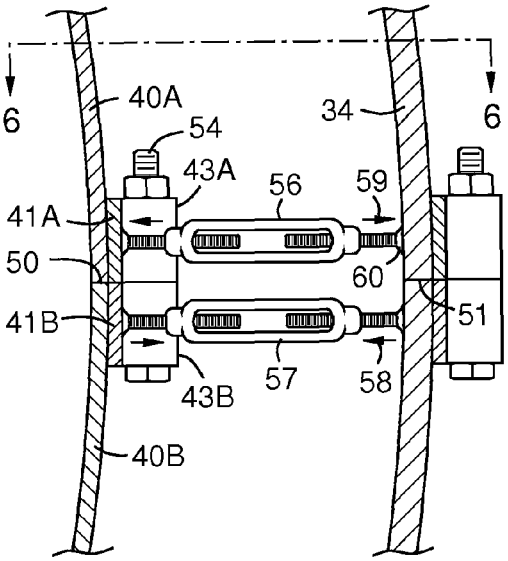
FIG. 5 is a sectional view of the bolt flange joint of FIG. 3 connected to the surrounding casing of the exhaust section by turnbuckles.

FIG. 5 is a front sectional view of the joint 50 between the upper 40A and lower 40B halves of the outer diffuser shell disposed inside the exhaust section casing 34. Turnbuckles 56, 57 span between each respective bolt flange 41A, 41B and the casing 34 on respective sides of casing joint 51. These turnbuckles provide radial adjustment of one or both flanges as needed for alignment. Each turnbuckle is capable of providing at least tensile force 58, and may also be capable of providing compressive force 59. For example, the ends of the turnbuckles may be welded 60 to the flanges and the casing as shown. This makes each turnbuckle capable of provide both tension or compression as needed for alignment, so that bolts 54 can be inserted through the upper 43A and lower 43B bolt bosses.

FIG. 6 is a top sectional view of one side of the upper half 40A of the diffuser outer shell disposed within the exhaust section casing 34. Adjustable bracing in the form of turnbuckles 56A-D radially aligns the bolt flange 41A as previously described. In this embodiment, each turnbuckle is attached between two clevis fittings 62. This allows the turnbuckles to be easily removed after the horizontal joint 50 is aligned and bolted together. Each clevis fitting may have a clevis pin or bolt 63 as shown. The number of turnbuckles used may vary from unit to unit. The turnbuckles at each location may be of different lengths and/or thicknesses. The turnbuckle 56A nearest the forward end of the diffuser may be longer than the turnbuckle 56D nearest the aft end, and may also be thicker in cross sectional area to support the greater turnbuckle length and a higher rigidity of the forward end of the diffuser. Optionally, the bolt bosses 43A, 43B may be attached to the upper/lower shells 40A, 40B of the diffuser without a continuous flange 41A, and/or the turnbuckles may be attached directly to the upper/lower shells 40A/40B.

FIG. 7 shows a clevis fitting with parallel upper and lower plates 62A, 62B, at least one of which may be threaded to retain a threaded bolt 63A. The bolt hole in the upper plate 63A may be unthreaded and large enough to pass the bolt without interference. If the plates 62A, 62B are horizontal as shown, and only the lower plate is threaded as shown, the turnbuckle eye 66 (FIG. 9) can be inserted between the plates, and the bolt 63A can be dropped through the hole in the upper plate, where it is then retained by gravity until it is secured by turning it into the threads of the lower plate 62B. This makes attachment and detachment fast and reliable, and minimizes the number of parts. If a threaded bolt is used, and one or both plates 62A, 62B are threaded, then neither a cotter pin nor a nut is needed. FIG. 8 shows a clevis fitting 62 with a clevis pin 63B that may be retained in unthreaded plates 62A of the fitting by a cotter pin 64.

FIG. 9 shows a turnbuckle 56 with eye bolts 65 having eyes 66 that are inserted into the clevis fittings 62. The eyes may be formed by casting or other means. Cast eyes are especially capable of supporting both tension and compression modes of the turnbuckle, as are eyes formed as closed loops that are welded closed.

FIG. 10 shows an alternate turnbuckle design 67 with clevis-end bolts 68. Only simple eye fittings are required to retain this turnbuckle. A turnbuckle with open hooks can also be used on a simple eye fitting, especially if only the tension mode of the turnbuckles is sufficient for alignment.

Figure 11:
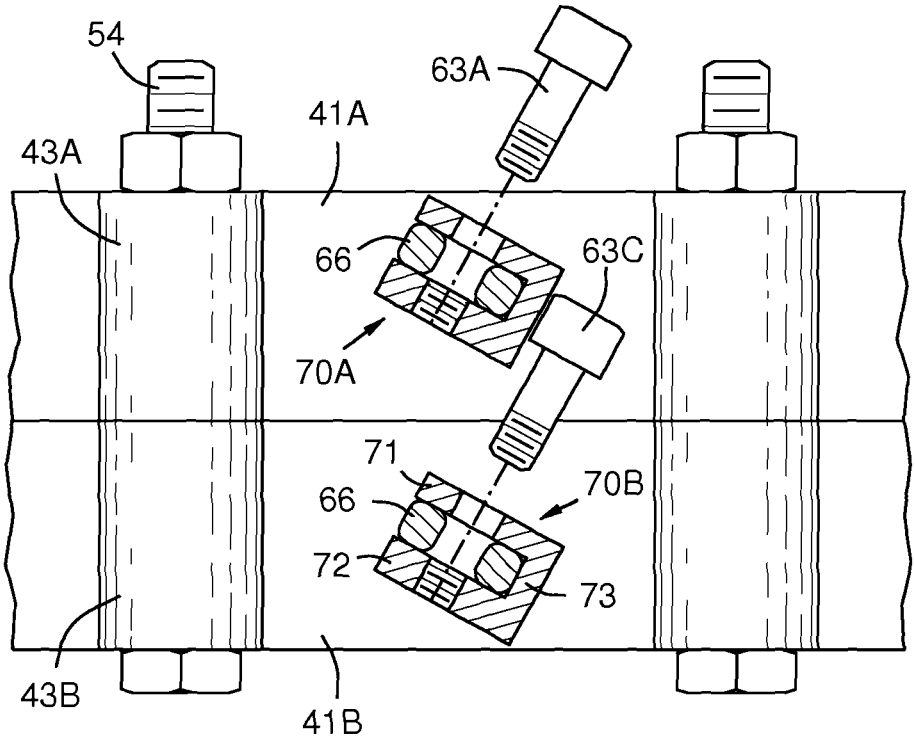
FIG. 11 is a partial sectional view an arrangement of upper/lower clevis fittings.

FIG. 11 shows a partial sectional view an arrangement of upper/lower clevis fittings 70A, 70B that retains upper/lower turnbuckle eyes 66 and threaded clevis bolts 63A, 63C by gravity until the clevis bolts are secured by turning them into the threads. Each clevis fitting has parallel upper and lower plates 71, 72, at least one of which may be threaded, and a side plate 73 that blocks a lower end of the space between the parallel plates. The clevis fittings are angled from horizontal enough that insertion of the lower clevis bolt 63C into the lower clevis fitting 70B is not blocked by the upper clevis fitting 70A.

Figure 12:
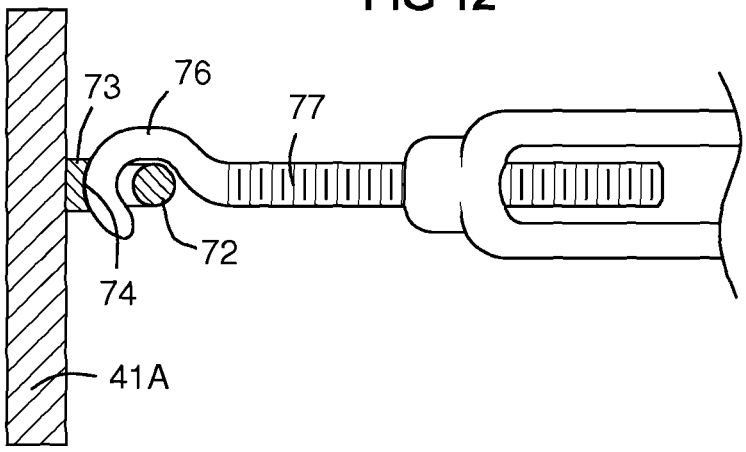
FIG. 12 is a front sectional view of an eye fitting that retains a hook end of a turnbuckle in moderate compression and tension.

FIG. 12 is a front sectional view of an eye fitting 72 having a base 73 with a convex contact surface 74 that matches the end of the hook 76 to stably retain the hook end 76 of a turnbuckle bolt 77 in compression. This allows moderate tension and compression without a clevis attachment.

After the upper and lower halves of the diffuser are aligned and bolted together, the turnbuckles may be removed for engine operation by detachment from the fittings 62. If the turnbuckles are welded as in FIG. 5, they may be cut off.

The concepts of the present invention may be used during the transportation of a gas turbine engine wherein the exhaust section is typically shipped in two halves separated along the horizontal joint. Adjustable length braces such as the turnbuckles described above may be installed at the factory or other point of origin of a transportation route to secure the relative positions of the diffuser halves in relation to the respective casing halves so that the flanges and bolt holes of the two halves are not dislocated with respect to each other as a result of loads imposed during transportation. Upon arrival at the destination, some minor adjustment of the bolt hole locations may or may not be necessary and can be achieved by adjusting the length of the appropriate brace(s) in order to facilitate the assembly of the exhaust section.

The concepts of the present invention may also be used for assembly of a gas turbine engine. In one embodiment, an upper half of an exhaust diffuser is mounted on a lower half of the exhaust diffuser along a horizontal joint, and the diffuser is located within a casing of the exhaust section. A plurality of length adjustable braces are mounted on at least one and preferably both of the upper and lower halves of the exhaust diffuser along the horizontal joint to provide relative motion of the bolt holes and the surrounding casing. The lengths of the braces are then adjusted to align the bolt holes in the upper and lower halves of the diffuser flange, and the horizontal joint is then secured together with bolts through the bolt holes. The braces are then removed prior to operation of the gas turbine engine.

The concepts of the invention may also be used during a maintenance outage for a gas turbine engine. Adjustable length braces are attached between the diffuser halves and the surrounding casing halves prior to the separation at the horizontal joint. The braces serve to secure the relative positions of the bolt holes and the respective casing halves when the horizontal joint bolts are removed and the two halves are separated for service. Upon reassembly, the respective upper and lower bolt holes will align or may require minor adjustment of the length of the braces to achieve alignment.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A gas turbine exhaust assembly comprising:

a diffuser shell comprising a first section joined to a second section at a joint there between;

a plurality of pairs of bolt bosses along a length of the joint, wherein each pair of bolt bosses comprises a first bolt boss on the first section and a second bolt boss on the second section, wherein the first and second bolt bosses of each respective pair are opposed across the joint;

a casing around the diffuser shell;

a first plurality of length adjustable braces attached between the first section and the casing; and a second plurality of length adjustable braces attached between the second section and the casing, wherein the first and second pluralities of length adjustable braces form a series of pairs of turnbuckles, wherein each pair of turnbuckles comprises a first radially oriented turnbuckle attached between the first section of the diffuser shell and the casing by clevis fittings, and a second radially oriented turnbuckle welded or releasably attached between the second section of the diffuser shell and the casing clevis fittings, wherein the first and second turnbuckles of each pair are opposed across the joint, wherein each of the clevis fittings comprises parallel first and second plates and a side plate that blocks a lower end of a space between the first and second parallel plates, wherein when an eye of one of the turnbuckles is inserted between the first and second parallel plates it is retained therein by gravity.

2. The gas turbine exhaust assembly of claim 1, wherein each pair of turnbuckles comprises a first radially oriented turnbuckle attached between the first section of the diffuser shell and the casing, and a second radially oriented turnbuckle attached between the second section of the diffuser shell and the casing, wherein the first and second turnbuckles of each pair are opposed across the joint.

3. The gas turbine exhaust assembly of claim 1, wherein each of the clevis fittings comprises two parallel plates between which an eye of one of the turnbuckles is retained by a clevis bolt or pin.

4. The gas turbine exhaust assembly of claim 3, wherein two parallel plates are horizontal.

5. The gas turbine exhaust assembly of claim 1, wherein the clevis fittings are arranged so that respective clevis bolts or pins can be inserted into each of the clevis fittings from an upper side thereof when the first and second sections of the diffuser shell are in contact along the length of the joint.

6. The gas turbine exhaust assembly of claim 1, wherein the braces are attached to the casing by welds.

7. A gas turbine exhaust assembly comprising:

a diffuser shell comprising an upper half joined to a lower half along a horizontal joint there between;

an upper bolt flange on the upper half of the diffuser shell adjacent the joint;

a lower bolt flange on the lower half of the diffuser shell adjacent the joint;

a series of bolt holes passing through respective opposed bosses on the upper and lower bolt flanges along a length of the joint;

an exhaust section casing around the diffuser shell; and a plurality of length adjustable braces spanning between the diffuser shell and the exhaust section casing, wherein the plurality of length adjustable braces comprises:

a series of upper turnbuckles, each upper turnbuckle releasably attached at one end thereof to the upper bolt flange via a respective upper clevis fitting;

a series of lower turnbuckles, each lower turnbuckle releasably attached at one end thereof to the lower bolt flange via a respective lower clevis fitting;

wherein each of the upper clevis fittings is opposed to a respective one of the lower clevis fittings across the joint forming a series of pairs of opposed upper/lower clevis fittings; and wherein each of the turnbuckles is releasably attached at a second end thereof to the exhaust section casing in a radial orientation, wherein each clevis fitting comprises parallel upper and lower plates angled from horizontal, and a side plate that blocks a lower end of a space between the upper and lower parallel plates, wherein when an eye of one of the turnbuckles inserted between the first and second parallel plates it is retained therein by gravity.

8. The gas turbine exhaust assembly of claim 7, wherein each upper turnbuckle is releasably attached radially between the upper bolt flange and the casing; and a series of lower turnbuckles, each releasably attached radially between the lower bolt flange and the casing, wherein each of the upper turnbuckles is opposed to one of the lower turnbuckles across the joint.

9. The gas turbine exhaust assembly of claim 7, wherein the upper and lower clevis fitting of each pair are arranged to receive a respective clevis bolt from an upper side thereof when the upper and lower sections of the diffuser shell are in contact with each other along the length of the joint.

10. The gas turbine exhaust assembly of claim 7, wherein each length adjustable brace comprises two hook ends that are hooked respectively at one end into an eye on one of the bolt flanges and the other end to an eye on the casing.

11. The gas turbine exhaust assembly of claim 7, wherein each length adjustable brace comprises first and second ends, wherein the first end is welded to one of the bolt flanges, and the second end is welded to the casing.

12. The gas turbine exhaust assembly of claim 7, wherein the length adjustable braces are welded between the diffuser shell and the exhaust section casing.

13. A method implemented with a gas turbine exhaust assembly, the exhaust assembly comprising a diffuser shell comprising a first section joined to a second section at a joint there between, and a plurality of pairs of bolt bosses along a length of the joint, wherein each pair of bolt bosses comprises a first bolt boss on the first section and a second bolt boss on the second section, wherein the first and second bolt bosses of each respective pair are opposed across the joint, and a casing around the diffuser shell, the method comprising:

attaching a plurality of length adjustable braces between the diffuser shell and the casing; and performing the attaching step at a first location;

transporting the exhaust assembly from the first location to a second location with the braces attached; and removing the braces from the exhaust assembly at the second location.

14. The method of claim 13, further comprising:

performing the attaching step while the first and second sections are joined by a plurality of bolts passing through the respective pairs of bolt bosses;

removing the bolts with the braces still attached and separating the first and second sections;

rejoining the first and second sections and reinstalling the bolts with the braces still attached; and removing the braces from the exhaust assembly.

15. The method of claim 13, further comprising adjusting the length of at least some of the braces to align respective pairs of bolt bosses.

* * * * *